US007658296B2

(12) United States Patent
Van Handel et al.

(10) Patent No.: US 7,658,296 B2
(45) Date of Patent: Feb. 9, 2010

(54) SEALABLE PORTION CUPS AND LIDS THEREFOR

(75) Inventors: Gerald J. Van Handel, Neenah, WI (US); Rebecca E. Whitmore, Chilton, WI (US); Loren G. Baker, Saylorsburg, PA (US); Jonathan E. Rush, Mount Bethel, PA (US)

(73) Assignee: Dixie Consumer Products LLC, Atlanta, GA (US)

( * ) Notice: Subject to any disclaimer, the term of this patent is extended or adjusted under 35 U.S.C. 154(b) by 56 days.

(21) Appl. No.: 11/851,772

(22) Filed: Sep. 7, 2007

(65) Prior Publication Data

US 2007/0295721 A1 Dec. 27, 2007

Related U.S. Application Data

(63) Continuation of application No. 10/911,044, filed on Aug. 4, 2004, now abandoned, which is a continuation-in-part of application No. 10/751,786, filed on Jan. 5, 2004, now abandoned, which is a continuation-in-part of application No. 10/456,207, filed on Jun. 6, 2003, now abandoned.

(60) Provisional application No. 60/389,533, filed on Jun. 18, 2002.

(51) Int. Cl.
*A47G 19/00* (2006.01)
*B65D 21/02* (2006.01)

(52) U.S. Cl. ..... 220/23.4

(58) Field of Classification Search ..... 220/23.4, 220/23.6, 23.83, 4.21, 23.8, 784, 835; 206/820
See application file for complete search history.

(56) References Cited

U.S. PATENT DOCUMENTS 1,941,050 A 12/1933 Punte (Continued)

FOREIGN PATENT DOCUMENTS

CH 619665 10/1980

(Continued)

OTHER PUBLICATIONS

Throne, Thermoforming, 1987, pp. 21-29, Hanser Publishers, Munich, Germany.

(Continued)

*Primary Examiner*—Harry A Grosso
(74) *Attorney, Agent, or Firm*—Michael S. Kerns

(57) ABSTRACT

A container ensemble for food packaging comprising a substantially planar lid member formed of a polymeric material which has a plurality of substantially planar lids which are integrally formed and separably joined to each other, each of the lids including a sealing channel around its perimeter and a skirt extending outwardly therefrom. The lid member is provided with tearable portions to facilitate separation. The other component of the ensemble is a cup member formed of a polymeric material defining a plurality of cups which are integrally formed and also separably joined to each other, the cups including a bottom, a sidewall, and a brim about an upper opening of each cup. Each cup has a skirt extending outwardly from its brim provided with tearable portions to facilitate separation. The sealing channels of the lids of the lid member are adapted to mate with the brims of the cups to provide a plurality of separably joined sealed containers when the lid member and cup member are joined in sealing engagement; the ensemble being thereby adapted for sequentially: (i) receiving serving portions of food in a plurality of cups; (ii) lidding the cups to provide sealed containers containing individual portions; (iii) separating the sealed containers; and (iv) distributing the portions.

20 Claims, 7 Drawing Sheets

U.S. PATENT DOCUMENTS

| | | | | |
|---|---|---|---|---|
| 2,302,045 | A | | 11/1942 | Neumann et al. |
| 2,825,450 | A | | 3/1958 | Lambert |
| 3,021,001 | A | * | 2/1962 | Donofrio ..... 220/23.4 |
| 3,054,679 | A | | 9/1962 | Bradford |
| 3,115,266 | A | | 12/1963 | Poupitch |
| 3,389,825 | A | * | 6/1968 | Whiteford ..... 220/23.4 |
| 3,420,431 | A | | 1/1969 | Donovan |
| 3,448,888 | A | | 6/1969 | Smith et al. |
| 3,647,055 | A | | 3/1972 | Pfaff |
| 3,715,856 | A | | 2/1973 | Borel |
| 3,757,983 | A | | 9/1973 | McCarthy |
| 4,054,207 | A | | 10/1977 | Lazure et al. |
| 4,105,121 | A | | 8/1978 | Mascetti |
| 4,215,797 | A | | 8/1980 | Chen |
| 4,296,863 | A | | 10/1981 | Stokkers |
| 4,398,634 | A | | 8/1983 | McClosky |
| 4,421,244 | A | | 12/1983 | Van Melle |
| 4,593,819 | A | | 6/1986 | Will |
| 4,753,766 | A | | 6/1988 | Pinsolle et al. |
| 4,798,133 | A | | 1/1989 | Johnson |
| 4,829,006 | A | | 5/1989 | Smith et al. |
| 4,875,620 | A | | 10/1989 | Lane, Sr. |
| 5,012,971 | A | | 5/1991 | Cozzi et al. |
| 5,024,067 | A | | 6/1991 | Maier, II |
| 5,037,000 | A | | 8/1991 | Selame |
| 5,160,767 | A | | 11/1992 | Genske et al. |
| 5,221,040 | A | | 6/1993 | Sorenson |
| 5,300,748 | A | | 4/1994 | Colombo |
| 5,320,279 | A | | 6/1994 | Giblin et al. |
| 5,332,147 | A | | 7/1994 | Sorenson |
| 5,334,272 | A | | 8/1994 | Takata et al. |
| 5,366,104 | A | | 11/1994 | Armstrong |
| 5,377,860 | A | | 1/1995 | Littlejohn et al. |
| 5,398,068 | A | | 3/1995 | Liu et al. |
| 5,409,127 | A | | 4/1995 | Strafford et al. |
| 5,417,365 | A | | 5/1995 | Lindsay |
| 5,456,379 | A | | 10/1995 | Krupa et al. |
| 5,531,349 | A | | 7/1996 | Wojcik et al. |
| 5,543,104 | A | | 8/1996 | Stratford et al. |
| 5,584,408 | A | | 12/1996 | Orkisz |
| 5,702,017 | A | | 12/1997 | Goncalves |
| 5,720,406 | A | | 2/1998 | Fassbind et al. |
| 5,722,553 | A | | 3/1998 | Hovatter |
| 5,904,263 | A | | 5/1999 | St. Pierre et al. |
| 5,979,690 | A | | 11/1999 | Hartley et al. |
| 6,000,535 | A | | 12/1999 | Berk et al. |
| 6,032,827 | A | | 3/2000 | Zettle et al. |
| 6,047,819 | A | | 4/2000 | Borst et al. |
| 6,076,698 | A | | 6/2000 | Magidson |
| 6,211,500 | B1 | | 4/2001 | McCarthy et al. |
| 6,211,501 | B1 | | 4/2001 | Cochran, II et al. |
| 6,629,834 | B2 | | 10/2003 | Cargile et al. |
| 6,805,659 | B2 | | 10/2004 | Bohrer |
| 2002/0037378 | A1 | | 3/2002 | Littlejohn et al. |
| 2002/0088737 | A1 | | 7/2002 | Stepp |
| 2003/0141218 | A1 | | 7/2003 | Stephens et al. |
| 2003/0230582 | A1 | | 12/2003 | Whitmore et al. |
| 2004/0164076 | A1 | | 8/2004 | Baker et al. |
| 2005/0011898 | A1 | | 1/2005 | Van Handel et al. |

FOREIGN PATENT DOCUMENTS

| | | | |
|---|---|---|---|
| DE | 2444416 | A1 | 4/1976 |
| DE | 2653906 | A1 | 6/1978 |
| DE | 10012364 | A1 | 9/2001 |
| EP | 0275102 | A2 | 7/1988 |
| EP | 0284349 | A2 | 9/1988 |
| EP | 0348142 | A2 | 12/1989 |
| EP | 0412029 | A1 | 2/1991 |
| EP | 0605082 | A1 | 7/1994 |
| EP | 0841150 | A2 | 5/1998 |
| FR | 1278149 | | 12/1961 |
| FR | 1392947 | | 2/1965 |
| FR | 2763314 | A1 | 11/1998 |
| GB | 649541 | | 1/1951 |
| GB | 2156658 | A | 10/1985 |
| RU | 19027 | U1 | 8/2001 |
| WO | 03/106276 | A1 | 12/2003 |
| WO | 2005/068306 | A1 | 7/2005 |

OTHER PUBLICATIONS

European Patent Office, International Search Report of the International Searching Authority for PCT/US03/17910, mailing date Sep. 29, 2003.

European Patent Office, International Search Report and Written Opinion of the International Searching Authority for PCT/US2004/043045, mailing date Mar. 17, 2005.

European Patent Office, International Search Report and Written Opinion of the International Searching Authority for PCT/US2005/000240, mailing date Jun. 28, 2005.

Decision of granting a patent for invention for Russian Application No. 2006128604, mailing date Feb. 19, 2009.

* cited by examiner

SEALABLE PORTION CUPS AND LIDS THEREFOR

CLAIM FOR PRIORITY

This non-provisional application is a continuation of co-pending U.S. patent application Ser. No. 10/911,044, entitled "Sealable Portion Cups and Lids Therefor," filed Aug. 4, 2004, which is a continuation-in-part of U.S. patent application Ser. No. 10/751,786, entitled "Lidded Container with Linear Brim Segments and Medial Sealing Beads," filed Jan. 5, 2004, which is continuation-in-part of U.S. patent application Ser. No. 10/456,207, entitled "Separable Containers Arranged in Arrays With Integrally Formed Lids," filed Jun. 6, 2003, which claims the benefit of the filing date of U.S. Provisional Patent Application Ser. No. 60/389,533, filed Jun. 18, 2002. The priorities of the foregoing applications are hereby claimed.

TECHNICAL FIELD

The present invention relates to disposable containers with lids for packaging fresh foods for distribution. Particularly preferred embodiments inclusive of 2, 4 and 6 ounce containers for sauces and condiments are thermoformed on complimentary sheets which may be joined in sealing engagement to each other and thereafter separated to supply individual portions.

BACKGROUND

Plastic containers with lids such as disposable plastic containers are well known. There is disclosed in U.S. Pat. No. 5,702,017 to Gonclaves a combination of a row of containers and a strip of caps, each of the containers and caps being respectively joined by breakable links allowing the joined strip of caps to be placed on necks of the joined row of containers by a translational movement parallel to the axes of the containers. See also U.S. Pat. No. 5,531,349 to Wojcik et al.; French patents 2 763 314 of APRI and 1 278 149 of GOIFFON.

Disposable articles are used as food containers as is seen, for example, in U.S. Pat. No. 5,012,971 to Cozzi et al. In the '971 patent there is disclosed a compartmented container of the "clam shell" class suitable for containing food. The container or package in one embodiment includes a first or bottom compartment and a second or top compartment that is hinged to the first compartment. There is disclosed in U.S. Pat. No. 4,798,133 to Johnson a package and container for eggs. The container defines a plurality of compartments each of a configuration to hold an egg captive, each portion of the container defining a respective single compartment being connected with the remainder along lines of weakening, perforation or the like.

Containers arranged in arrays with breakable or tearable portions between them are seen in a number of references. In this respect, German Patent DE 100 12 364 of von der Worth discloses separable egg cartons arranged in a planar array. See also DE 100 12 364; FR 2 763 314; and FR 1 278 149.

There is disclosed in U.S. Pat. No. 6,000,535 to Berk et al. disposable mixing wells. Wells are formed as a unitary sheet of individual mixing wells arranged in rows and columns. The boundary between each mixing well is scored, perforated or otherwise made to allow individual pieces to be removed from the sheet. Preferably, the mixing wells may be pressure formed rather than being vacuum formed.

There is disclosed in U.S. Pat. No. 5,904,263 to St. Pierre et al. a multi-container package with individually removable containers. The package includes several individually sealed containers which are easily separable from one another by weakened zones between adjacent containers. Each container includes a tab portion over which the peel tab of the lid extends. Dimples in either the peel tab or tab portion facilitate their separation. Several multi-container packages are manufactured as a unit using a die and conventional heat sealing process and then are separated from one another by transverse cuts.

U.S. Pat. No. 5,409,127 to Stratford et al. is directed to a multi-pack container assembly. The multi-pack assembly includes a plurality of containers and webs joining the containers, each web configured to include an area of reduced structural integrity for tearing a plurality of frangible ribs interconnecting adjacent containers and traversing the tearing area.

U.S. Pat. No. 4,875,620 to Lane, Sr. discloses a fluted product cup. The cup, suitable for food packaging is formed from a resilient material and has an integral body having a product reservoir and a lip. The product reservoir includes a flat bottom wall and a continuous sidewall integrally joined together about a smooth curve. The sidewall extends upwardly from the bottom wall to join the lip. The joint between the lip and the sidewall continuously surrounds and defines an opening through the lip to the interior of the reservoir. The lip extends in a plane outwardly from this opening completely around the periphery of this opening. The bottom wall is essentially circular in shape and the opening is essentially a square shape. First, second, third and fourth fluted areas are located in the sidewall at the corners of the squarish shaped opening at the top of the containers. Each of the fluted areas are shaped essentially as a conical surface generated from a cone which is truncated by a plane about a parabolic intersection of the plane with the cone. These containers may be formed in an array as can be seen in the patent.

With respect to containers which may be separated, the following references are also of interest. French Patent No. 1,392,947 to Skandinavisk; German Patent No. DE 26 53 906 to Gizeh-Werk and British Provisional Specification No. 649, 541 to Stephenson.

It is seen in U.S. Pat. No. 5,722,553 to Hovatter an integral assembly of microcentrifuge strip tubes having independently tethered caps and angularly related seal caps.

Food containers having sealing features are likewise well known. In this respect, ridges and cooperating grooves are used in many such containers. See U.S. Pat. No. 5,377,860 to Littlejohn et al.

While the container art is plentiful, there remain largely unresolved issues with respect to lidded containers of low cost that can exhibit superior sealing characteristics, even at low product weight. This is especially so with respect to containers having straight brim segments. Simply making a "tighter" fit between the lid and its associated container or receptacle is ineffective since the increase in the required capping force will crush the container, leading to product failure in too many instances as well as associated spillage.

Likewise, existing containers, especially relatively small containers, are difficult to individually fill and seal, making the process prohibitively time consuming or requiring equipment and skills not generally available at homes, catering establishments and restaurants.

SUMMARY OF INVENTION

The present invention provides food containers which are easily filled and sealed while the containers are connected to one another and then separated into individual containers containing a serving. Preferably the lids and cups form substantially continuous seals between them so that the containers are substantially liquid proof; it being understood that the seal, while highly effective, especially when viewed in light of the low cost nature of the articles, is of course less than perfect where the seal formed might allow a few drops of moisture to penetrate when a sealed container is partially filled with water and shaken; but compression, effort and/or agitation is required to remove more than a few drops of liquid. The containers are thus especially suitable for liquid or semi-liquid sauces, condiments, dressings, side dishes and so forth that are prepared and fresh-packaged shortly before consumption.

There is provided in one aspect of the invention a container ensemble for food packaging comprising: a substantially planar lid array member formed of a polymeric material defining a plurality of substantially planar lids which are integrally formed and separably joined to each other, each of the lids including a sealing channel around its perimeter and a skirt extending outwardly therefrom provided with tearable portions to facilitate separation; a cup member formed of a polymeric material defining a plurality of cups which are likewise integrally formed and separably joined to each other, the cups including a bottom, a sidewall, and a brim about an upper opening of each cup. Each cup further includes a skirt extending outwardly from its brim provided with tearable portions to facilitate separation. The sealing channels of the lids of the lid member are adapted to mate with the brims of the cups to provide a plurality of separably joined sealed containers when the lid member and cup member are joined in sealing engagement. The ensemble is accordingly adapted for sequentially: (i) receiving serving portions of food in a plurality of cups; (ii) lidding the cups to provide sealed containers containing individual portions; (iii) separating the sealed containers; and (iv) distributing the portions. The container ensemble is preferably thermoformed from thermoplastic sheet.

The ensemble may be formed from a single sheet of thermoplastic resin so that the lid member is integrally fabricated with the cup member and is optionally hinged thereto. The tearable portions are scored and/or perforated. The container ensemble is advantageously fabricated from different sheets, optionally sheets of different color, that is, the lid member and said cup member are fabricated as separate components wherein the cups and lids have different color or are made from different caliper material or from different polymeric materials. The container ensemble is typically configured such that the plurality of separably joined cups arc arranged in an N×M array, N and M being independently selected integers from 1 to 6. Likewise, the lids are arranged in an N×M array, N and M being perhaps most preferably 2 and 3, but either integer may be 1 in some cases.

An especially preferred embodiment is where the brims of the cups are further provided: a plurality of rounded corner brim portions, and a plurality of lateral brim walls extending between the rounded brim corner portions, the walls being configured such that the surfaces are substantially linear along a direction between adjacent brim corners interconnected thereby; and the lids are suitably provided with: a plurality of lid rounded corner portions; and a plurality of lateral lid walls extending between the rounded corner portions wherein the lid rounded corner portions and the lid lateral walls are configured to engage corresponding brim corner portions and the lateral brim walls thereof, the lateral lid walls being configured such that their surfaces are substantially linear between adjacent lid corner portions interconnected thereby; and a plurality of medial sealing beads disposed on lateral walls selected from lateral brim walls and lateral lid walls, the sealing beads being characterized in that: the medial sealing beads project away from their respective lateral walls a maximum distance at a central portion thereof between and distal to adjacent corners with lesser projections away from their lateral walls at their end portions proximate adjacent corners; and the medial sealing beads extend over the major portion of the length of the lateral wall between adjacent corners upon which they are disposed. Preferably, the plurality of medial sealing beads extends over substantially the entire distance between rounded corners; and preferably the plurality of medial sealing beads defines an arched line between adjacent rounded corners such that the medial sealing beads blend with the rounded corners at their ends. Most preferably, the medial sealing beads are flush with rounded corners at their end portions and have an arched profile away from the lateral walls upon which they are disposed. In a typical embodiment, the lateral walls upon which the sealing beads are disposed have an upper portion and lower portion and the medial sealing beads are located proximate to the upper portions of the lateral walls upon which they are disposed, for example, the lateral walls upon which the medial sealing beads are disposed have a top and bottom defining a height and the medial sealing beads are disposed at the upper portion of its lateral wall at substantially two-thirds the height of the lateral wall.

In an especially preferred embodiment, the medial sealing beads have a maximum projection away from the lateral wall at substantially the center line of the lateral wall.

In another aspect of the invention, there is provided a method of distributing individual serving portions of a food item selected from condiments, dressings and side dishes comprising the sequential steps of: (1) disposing the serving portions of the food item in a plurality of cups provided in a cup array member formed of a polymeric material defining a plurality of cups which are integrally formed and separably joined to each other, the cups including a bottom, a sidewall, and a brim about an upper opening of each cup, each cup further including a skirt extending outwardly from its brim, the skirts of each cup including tearable portions to facilitate separation; (2) joining a lid array member to the cup member, the lid array member being substantially planar and formed of a polymeric material including a plurality of substantially planar lids which are integrally formed and separably joined to each other, each of the lids including a sealing channel around its perimeter and a skirt extending outwardly therefrom provided with tearable portions to facilitate separation; (3) whereupon joining the lid member and the cup member the sealing channels of the lids of the lid member mate with the brims of the cups to provide a plurality of separably joined sealed containers; (4) separating the sealed containers; and (5) distributing the individual portions. The serving portions of food items may be selected from ketchup, mayonnaise, mustard, relish, tartar sauce and salad dressing and the like.

A still further aspect of the invention is a packaging system including: (a) a nested stack of substantially planar lid array members formed of a polymeric material each defining a plurality of substantially planar lids which are integrally formed and separably joined to each other, each of the lids including a sealing channel around its perimeter and a skirt extending outwardly therefrom provided with tearable portions to facilitate separation, wherein the sealing channel defines a top recess on each lid; (b) a nested stack of cup members formed of a polymeric material defining a plurality of cups which are integrally formed and separably joined to each other, the cups including a bottom, a sidewall, and a brim about an upper opening of each cup, each cup further including a skirt extending outwardly from its brim, the skirts of each cup including tearable portions to facilitate separation, wherein further the bottom of each cup is configured to fit with the top recess of a lid such that an assembled lid/cup ensemble of sealed containers is securely stackable; (c) the sealing channels of each lid of the lid members being adapted to mate with the brims of the cups of a cup member to provide a plurality of separably joined sealed containers when the lid member and cup member are joined in sealing engagement; an assembled lid/cup ensemble of sealed containers being thereby adapted for sequentially: (i) receiving serving portions of food in a plurality of cups, (ii) lidding the cups to provide sealed containers containing individual portions; (iii) separating the sealed containers; and (iv) distributing the portions.

There is provided in a preferred embodiment the addition of a male bead along the straight side of a square (with round corners) soufflé container (hereinafter referred to as the cup) brim. This product may be produced in a six-pack design as is shown herein to be separated by the end user. A six-pack design is especially suitable for 2-ounce containers, while the inventive product may likewise be produced in a four-pack design which is especially suitable for 4 and 6 ounce containers. In still other cases, 1 or 1.5 ounce containers are preferred. The lid bead seal improvement achieved by way of the medial sealing bead is not limited to these configurations. The lid bead seal can be employed in connection with a wide variety of containers as described and claimed herein. The invention is perhaps most preferably incorporated into a bead of arcuate cross section or profile as is shown in FIG. 4 approximately one third the distance down from the top of the brim. The bead is at its fullest protrusion or projection at the center line of the straight side of the cup and is flush with to the corner radii on either side. The maximum height of the bead is most preferably 0.008 inches in the embodiments tested, progressively diminishing or feathering out to 0.000" so as to be flush at the corner radius. That is to say, the highest point of the 0.008" arc attains a crown on the center line of the cup when viewed from the top and tapers to be flush with the corner on both ends of the arc as is best appreciated from FIG. 3, where it is seen that the "end-to-end" curvature of the sealing beads is quite subtle, as is the case when the radius of curvature is quite large. Without intending to be bound by any theory, it is believed that the cup bead feature enhances the sealing function because it increases pressure between the lid and cup brim where it is normally at its lowest; that is, in the center of the flat sides. The flat sides of the square cup or container are difficult to seal due to the lack of pressure or contact along the flat side of the brim. Simply reducing the size of the lids distorts the cup and causes the brim to buckle and makes capping difficult. Because the bead provides a line of contact and exerts pressure where it is needed, leak resistance is greatly improved with minimal increase of capping force. The bead also acts as a strengthening rib to prevent buckling of the brim. The test data hereinafter included of improved leak resistance is in fact dramatically achieved without increasing the capping force required to seal the container.

Most preferably, the lidded container according to the present invention is thermoformed from a plastic material. Such materials may include polystyrene polymer compositions, such as high impact polystyrenes or rubberized polystyrene. Further polystyrenes contemplated for use in connection with the present invention include oriented polystyrene. Alternatively, the inventive containers may be made from a thermoplastic composition including a polyolefin polymer such as polypropylene or polyethylene. Still further suitable materials include polyester materials such as a thermoplastic composition including polyethylene terephthalate.

Instead of being made by way of thermoforming, the inventive containers may be made by injection molding if so desired. For ease of illustration, the beads are shown as being made by injection molding. Typically, each container has a fill volume of from about 1 to about 8 fluid ounces, such as from about 1 to about 4 or 6 fluid ounces, 6-ounce and 4-ounce containers sometimes being preferred. In the embodiments specifically illustrated hereinafter, the containers have a fill volume of about 2 fluid ounces and are particularly useful for condiments.

BRIEF DESCRIPTION OF DRAWINGS

The invention is described in detail below with reference to the drawings, wherein like numerals designate similar parts and wherein.

DETAILED DESCRIPTION

The invention is described in detail below with reference to several embodiments. Modifications of those embodiments within the spirit and scope of the present invention, set forth in the appended claims, will be readily apparent to those of skill in the art.

Figure 1:
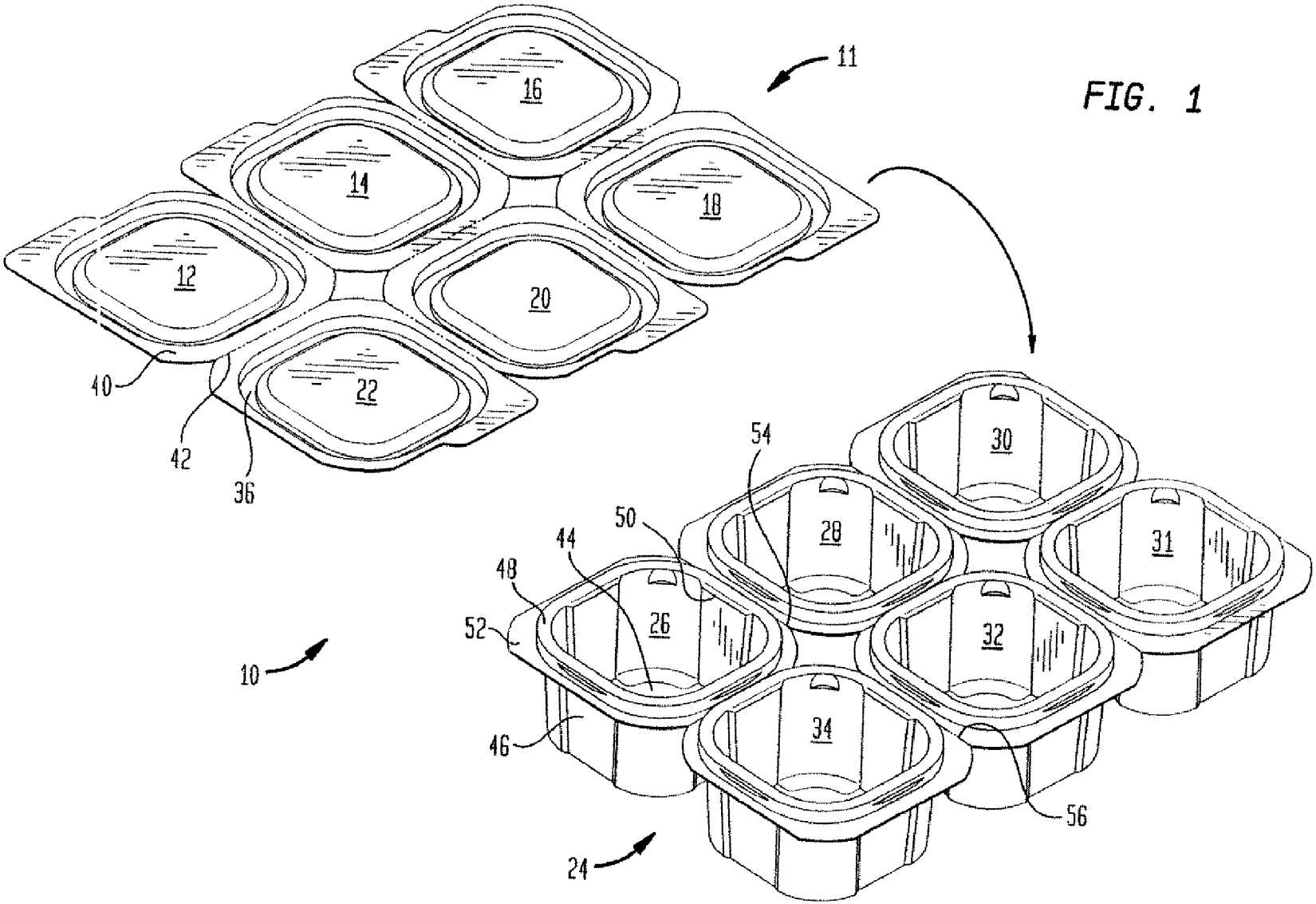
FIG. 1 is an exploded view in perspective of a thermoformed container/lid ensemble constructed in accordance with the present invention wherein the lids are thermoformed from one sheet of thermoplastic resin and the cups are thermoformed from another sheet of thermoplastic resin.

Referring to FIG. 1, there is illustrated a container ensemble 10 including a substantially planar lid array member 11 including lids 12, 14, 16, 18, 20 and 22 in a 2×3 arrangement as well as a cup array member 24 including cups 26, 28, 30, 31, 32 and 34. Both the lid and cup members are conveniently formed from a sheet of thermoplastic material as is well known in the art.

Each lid has a sealing channel such as channel 36 which is configured to cooperate with the corresponding brim cup to form a seal; that is channel 36 is configured to cooperate with brim 48 to form a sealed container which may be separated from the others after sealing. The lids are separably joined to each other by a skirt such as skirt 40 which has a scored or perforate tearable portion 42 so that the lids can be separated from one another.

Each cup of cup member 24 includes a bottom 44, a sidewall 46 and a brim 48 extending around an opening 50 of each cup. There is additionally provided a skirt 52 around each cup extending outward from its brim. The skirts include scored or perforate portions such as portions 54, 56 so that the cups can be separated from each other.

Figure 4:
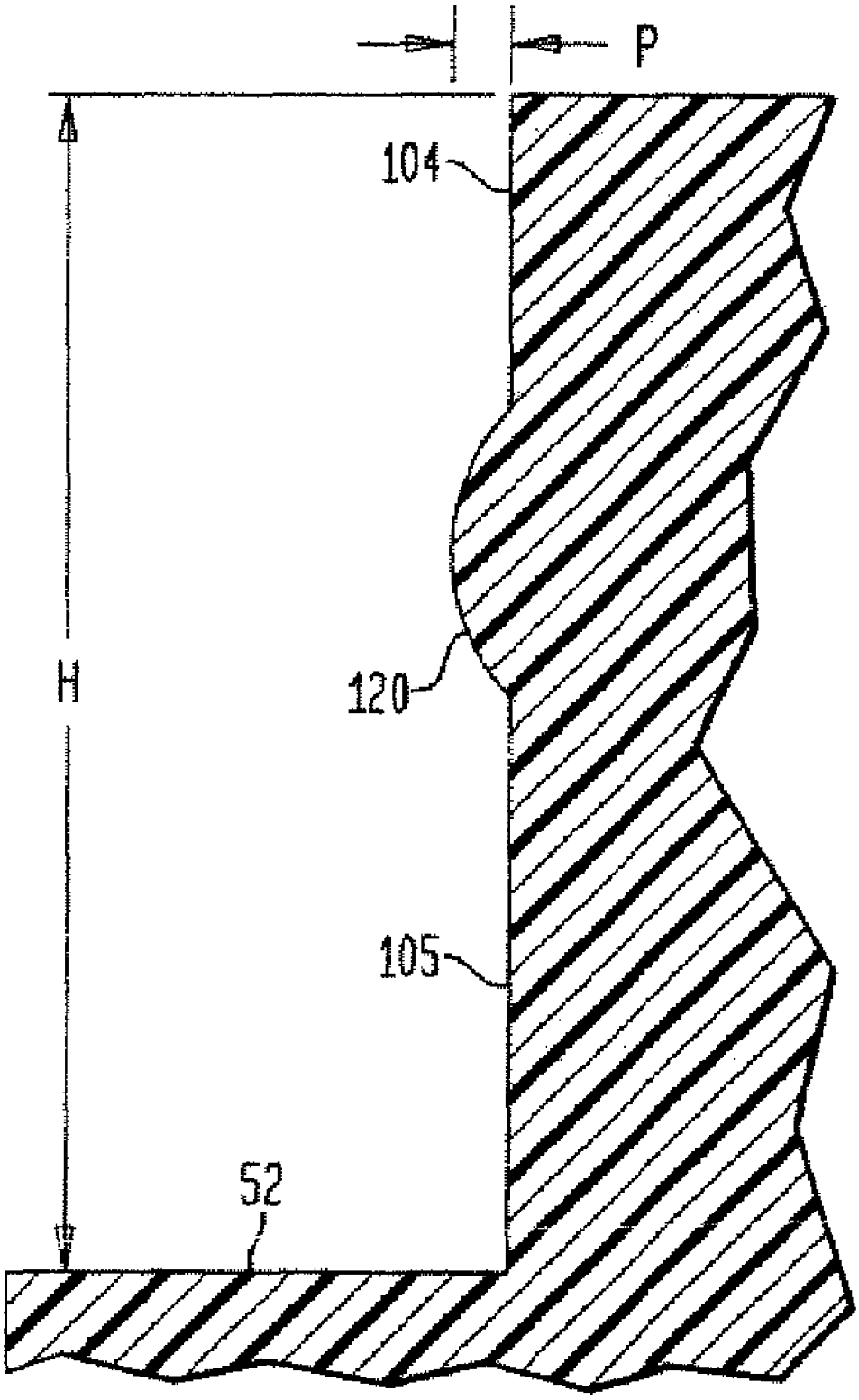
FIG. 4 is an enlarged schematic view illustrating the profile of the medial sealing bead.
Figure 5:
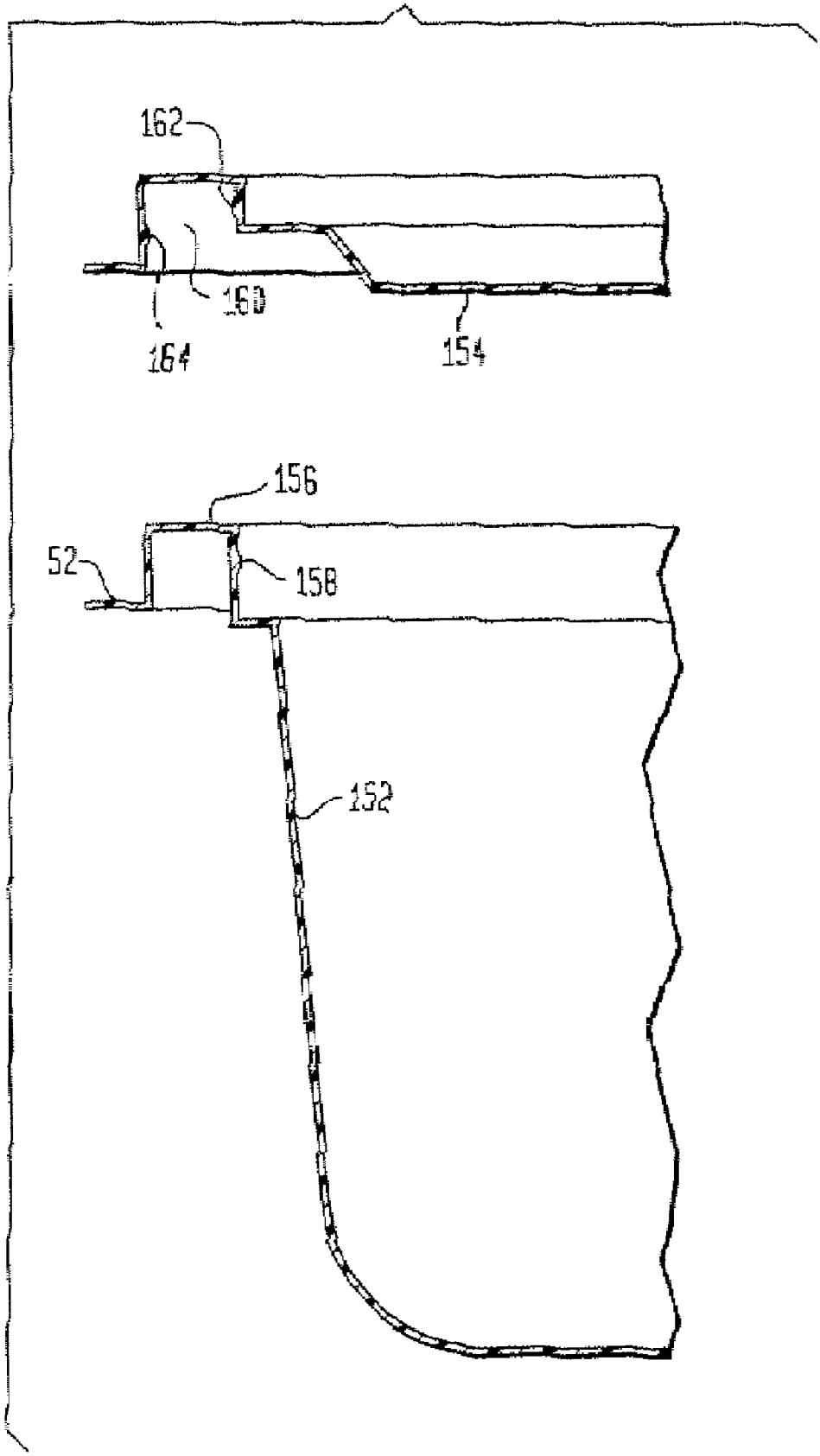
FIG. 5 is an exploded schematic view of a portion of a single container in profile illustrating alternate locations of medial sealing beads.

The profiles of lid 22 and brim 48 of cup 26 are likewise seen in FIG. 5. FIG. 5 has the same container shape as seen in FIGS. 1-4 except that the sealing beads are shown at alternative locations, discussed further below.

As will be appreciated from FIGS. 1 through 5, each container includes a cup or receptacle portion as well as an associated lid portion which may be joined together and sealed before separation. Each receptacle portion has a brim with a plurality of straight portions between rounded corners as will be particularly appreciated by reference to FIGS. 2 and 3.

Figure 2:
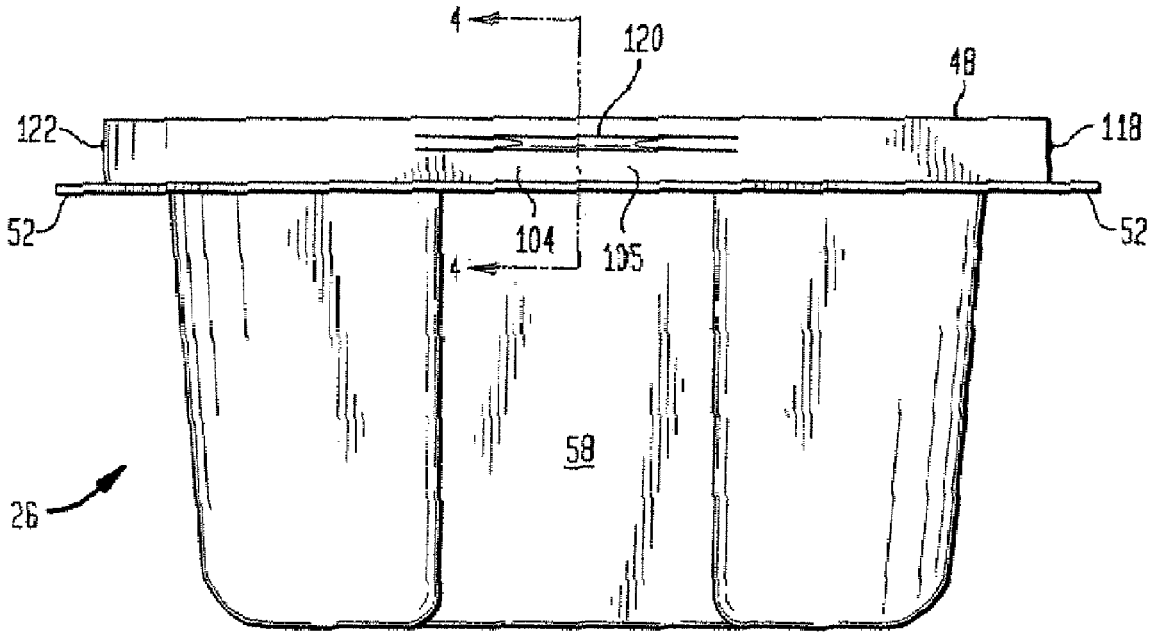
FIG. 2 is a view in elevation of an individual cup of the present invention provided with a medial sealing bead about the four (4) straight portions of its brim.
Figure 3:
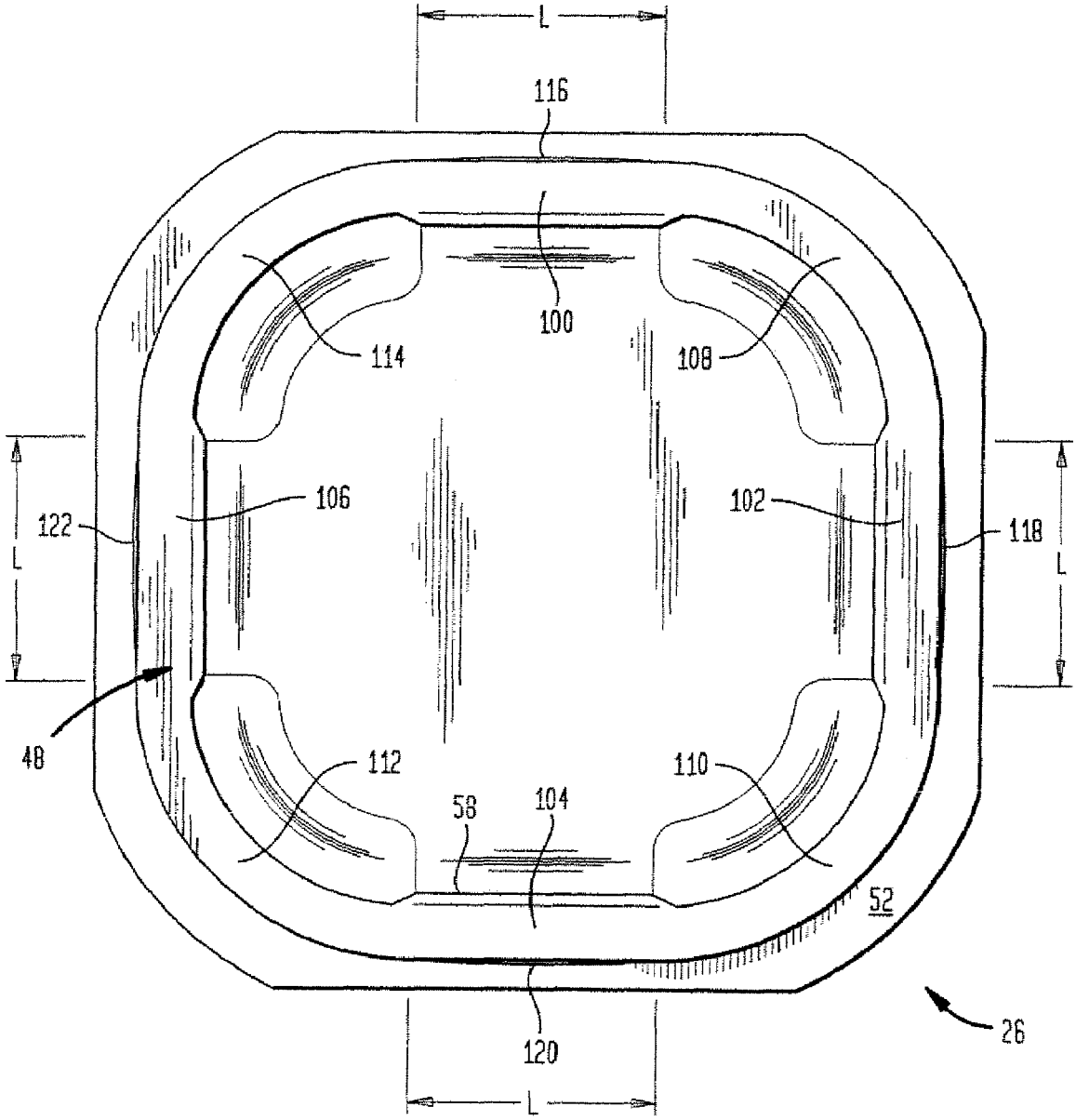
FIG. 3 is a top view of an individual cup of the present invention provided with medial sealing beads.

FIG. 2 is a view in elevation of cup 26 of FIG. 1, while FIG. 3 is a top plan view thereof. Cup 26 has a brim 48 provided with four linear segments 100, 102, 104, and 106. The linear segments are interconnected by rounded corners 108, 110, 112, and 114. Preferably the brim is U-shaped in profile as shown with generally flat (except for sealing beads) inner and outer sidewalls which define a U-shape together with its top. Likewise, the channels are most preferably U-shaped with flat walls cooperating to form a seal with the substantially rectangular, U-shaped brim when the parts are engaged. Each of the linear segments 100, 102, 104 and 106 of the brim has a medial sealing bead, 116, 118, 120, and 122 as shown extending substantially over the entire length, L, of the linear segment and blending with the corners between the linear segments. Most preferably, the medial sealing beads are arched in shape as shown and flush with the corner portions of the brim and are configured such that they generally progressively increase in projection from the walls of the brim as the distance from the adjacent corner portions increases. That is to say, the sealing beads project away from the brim a maximum distance at the center portion of the linear segment where they are disposed. This feature is perhaps best appreciated by reference to FIGS. 2 and 4. FIG. 4 is an enlarged schematic view in section along line 4-4 of FIG. 2, that is, at the center point of linear segment 104. Here the sealing bead 120 has its maximum projection indicated as P, away from surface 105 of brim segment 104 which may be about 8 mils (thousandths of an inch) or so for a 2-ounce container. It will be appreciated from the Figures, especially FIG. 3, that the curvature of the sealing beads is very subtle, that is, the beads have a very large radius of curvature from end to end. In the embodiment shown in FIGS. 1 through 4, the bead is disposed at a height which is approximately two-thirds the height, H, of brim portion segment 104 above surround skirt 52. Other positions of sealing beads are possible. That is to say, the sealing bead is located on wall surface 105 of brim portion segment 104 as shown in the diagram. The beads are in the same location on all straight segments of the brims on the containers shown in FIG. 1, as will be appreciated from FIGS. 2 and 3, especially.

Each of the cups and lids has all of the features of cup 26 and lid 22, discussed in more detail below. For example, the lid channels and brims have the shape shown schematically in FIG. 5, except that in FIGS. 1-4 the sealing beads are shown on the outer lateral walls of the sealing brim. Preferably the channels have a U-shaped profile as do all of the brims as shown in FIGS. 1 and 5. Note in FIGS. 1 and 5 the brims and channels have U-shaped profiles provided with flat inner and outer walls, except where the sealing bead is formed. Each receptacle portion or cup also has a surround or skirt extending outwardly from the brim on its lower edge as is seen in FIG. 1 and perhaps better appreciated from FIGS. 2 and 3 where the shaped construction of the sidewalls of the receptacle portion of the containers is likewise appreciated. That is to say the rounded corners of the containers as well as the recessed sidewalls 58 of the various cups may also be seen.

There are shown schematically in FIG. 5 alternate locations of sealing beads of the present invention.

FIG. 5 illustrates a container including a cup portion 152 as well as a lid portion 154. The cup portion has a brim 156 which might include a sealing bead on its inner wall as indicated at 158 instead of on the outer wall as in shown in FIGS. 1 through 4. Likewise, lid 154 may include a channel 160 provided with sealing beads on its inner wall as indicated at 162 and/or on its outer wall as indicated at 164. It is believed that the embodiment shown in FIGS. 1 through 4 is preferable for many containers of the present invention; however, the beads as described herein may be suitably located at one or more locations as is shown in FIG. 5.

The length of the maximum projection, P, away from the sidewall of the brim upon which the medial sealing bead is disposed has an impact on the seal improvement for the container. It is found in accordance with the present invention, that a seal with a maximum projection of 8 mils performed substantially better than a seal having a maximum projection of 0.005 inches or 5 mils. It is seen in the vinegar/oil leak test the percent pass for the 8 mil bead was 96 percent while only 46 percent of the 5 mil bead containers passed, suggesting that the projection distance impacts performance. Thus, if one looks at FIG. 3 the linear length, L, of a straight portion of the brim may be for example one inch or so for a 2-ounce container where the optimal projection length away from the sidewall of the brim may be about 8 mils. Thus suitably a preferred ratio of P/L is preferably from about 0.0075 to about 0.01. That is to say, for a one inch straight sidewall length the projection should be from about 7.5 to 10 mils or so. In other embodiments, preferred P/L ratios may vary. For example, P/L ratios of from about 0.0025 to about 0.025 are within the scope of the invention as are P/L ratios of from about 0.005 to about 0.015.

The integrally formed, container/lid arrays of the present invention may be conveniently formed by way of any conventional molding technique from a plastic material such as by a thermoforming process from a suitable thermoplastic sheet. "Thermoforming", "thermoformed" and like terminology is given its ordinary meaning. In the simplest form, thermoforming is the draping of a softened sheet over a shaped mold. In the more advanced form, thermoforming is the automatic high speed positioning of a sheet having an accurately controlled temperature into a pneumatically actuated forming station whereby the article's shape is defined by the mold, followed by trimming and regrind collection as is well known in the art. Still other alternative arrangements include the use of drape, vacuum, pressure, free blowing, matched die, billow drape, vacuum snap-back, billow vacuum, plug assist vacuum, reverse draw with plug assist, pressure bubble immersion, trapped sheet, slip, diaphragm, twin-sheet cut sheet, twin-sheet roll-fed forming or any suitable combinations of the above. Details are provided in J. L. Throne's book, *Thermoforming*, published in 1987 by Coulthard. Pages 21 through 29 of that book are incorporated herein by reference. Suitable alternate arrangements also include a pillow forming technique which creates a positive air pressure between two heat softened sheets to inflate them against a clamped male/female mold system to produce a hollow product. Metal molds are etched with patterns ranging from fine to coarse in order to simulate a natural or grain like texturized look. Suitable formed articles are trimmed in line with a cutting die and regrind is optionally reused since the material is thermoplastic in nature. Other arrangements for productivity enhancements include the simultaneous forming of multiple articles with multiple dies in order to maximize throughput and minimize scrap. In some preferred embodiments, the melt-compounded composition from which the articles are made may include polypropylene and optionally further includes a polyethylene component and titanium dioxide. Suitable materials and techniques for fabricating the disposable containers of the present invention from thermoplastic materials appear in U.S. Pat. No. 6,211,501 to McCarthy et al. as well as U.S. Pat. No. 6,211,500 to Cochran II et al. the disclosures of which are incorporated herein by reference. When thermoformed, the containers are made from sheet having a caliper of from about 5 to 30 mils; typically from about 10 to 20 mils.

Alternatively, the lid/container ensemble may be injection molded however, thermoforming is generally preferred.

The present invention provides a unique combination of leak resistance and ease of capping. This latter feature is very important especially for thermoformed articles which tend to crash if the capping force required is too high. This will be appreciated from the discussion which follows.

Product Testing

Products were tested for water or vinegar/oil leakage as follows: (a) with the containers still inter-connected and with their lids still inter-connected, they were filled with water or a 50/50 mixture of vinegar and vegetable oil; (b) the containers were then closed; (c) the containers were then separated from one another and placed on blotter paper; (d) each container was then placed on a side thereof, the side selected not having a hinge or tab; (e) the container was allowed to remain on its side for up to ten minutes; (f) if the container did not leak in 10 minutes, it was recorded as a pass; all others were recorded as failures; and (g) the test was repeated for another container ensemble, but the containers were placed on their sides opposite to those of the first trial.

The capping force test was conducted as follows: (a) with the containers uncapped, individual containers were separated from six-pack units, care being taken not to tear or damage the brim of the cup; (b) the test specimen, including cup and cap, was placed in an automated capping tester with a preset gauge height sufficient to receive the container without interference; (c) if the cup and lid were connected the lid was folded into a capping position, containers with separate cups and lids were prepared by placing the lid loosely in position on the cup brim; and a force gauge was zeroed and the speed set to 2½"/minute; (d) the tester drive was activated and the cross arm advanced until the cap was fully seated on the cup; (e) the container was inspected for damage; and (f) the capping force was recorded.

Initially the containers were made without medial sealing beads and did not perform well in the leak test. Initial trials involved making the lids tighter; however more than half of these containers were crushed during capping. It was found however, that with a required capping force of four (4) pounds or so, no containers were crushed. The inventive design was conceived and tested after these initial failures. Composite results are shown in Table 1. Table 1 reflects the early approach toward improving leak testing by making a tighter cap, but as can be seen from Table 1 this resulted in an unacceptably high rate of crushing of the container during capping, More importantly, it is seen from the data that with the present invention the containers are remarkably more leak resistant.

TABLE 1

| | Leak/Cap Testing | | | | | | |
|---|---|---|---|---|---|---|---|
| | Water Leak (% Pass) | Vinegar/ Oil Leak (% Pass) | Capping Force with Hinge (lb.) | % Crushed When Capped with Hinge | Capping Force without Hinge (lb.) | % Crushed When Capped without Hinge | Avg 6 Pack Weight (grams) |
| Invention Tooling | 100% | 71% | 4.8 | 0* | 4.4 | ○* | 31.694 |
| Tooling A Without Sealing Bead | 0% | 0% | 8.5 | 58% | 8.2 | 58% | 29.759 |
| Tooling B Without Sealing Bead | 75% | 0% | 4.1 | 0* | 4.3 | ○* | 29.870 |

| Vinegar/Oil Leak Breakdown | |
|---|---|
| % Pass (0.008" Bead) | 96% |
| % Pass (0.005" Bead) | 46% |

*very low percentage, believed negligible

In Table 1 there is seen a dramatic increase in leak resistance with the invention design, without the need for increased capping force and associated crushing of the containers.

Figure 6:
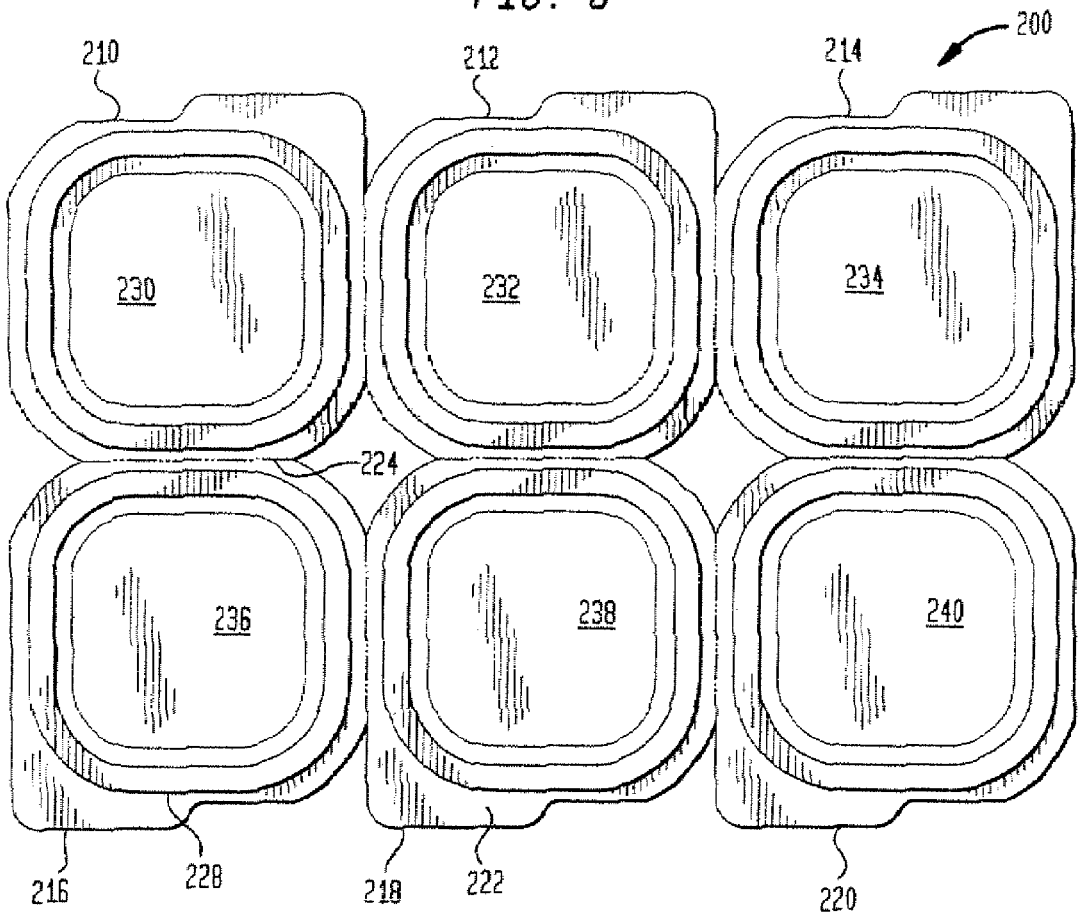
FIG. 6 is a top plan view of a stack of nested lid array members.
Figure 7:
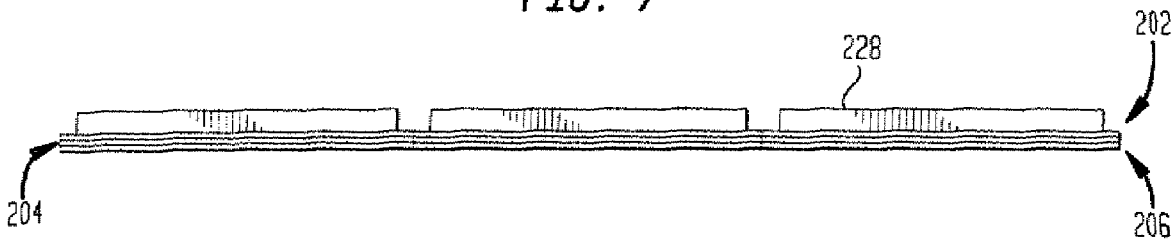
FIG. 7 is a view in elevation of a stack of nested lid array members.

Referring to FIGS. 6 and 7, there is shown a nested stack 200 of lid members 202, 204 and 206 each of which includes a plurality of nested lids such as lids 210, 212, 214, 216, 218 and 220 which are integrally formed and separably joined to each other by skirts such as skirt 222 which includes scored or perforated regions 224 to facilitate separation. Each individual lid has a channel such as channel 228 around its perimeter defining a plurality of top recesses 230, 232, 234, 236, 238 and 240 which are configured to receive the bottoms of cups of a corresponding cup member (FIGS. 8 and 9) so that assembled containers are securely stackable. The channels themselves seal with the brims of corresponding cups as discussed above.

Figure 8:
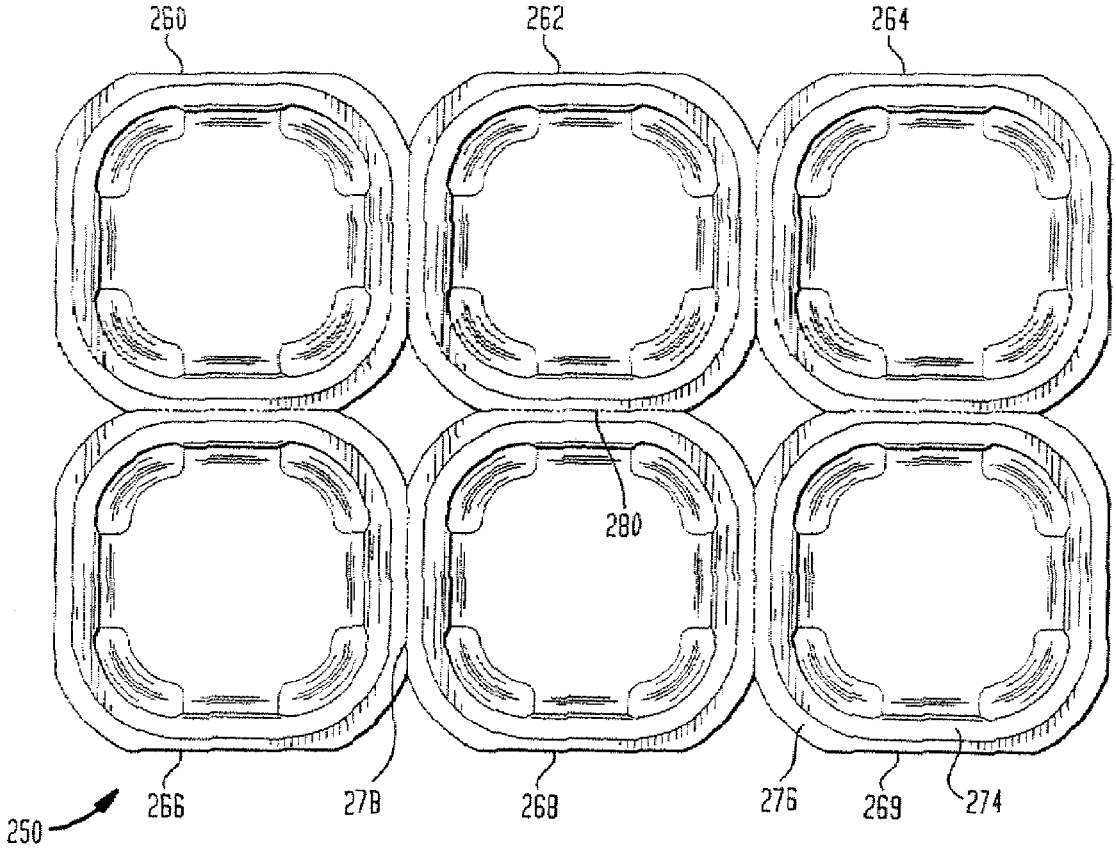
FIG. 8 is a plan view of a stack of nested cup array members.
Figure 9:
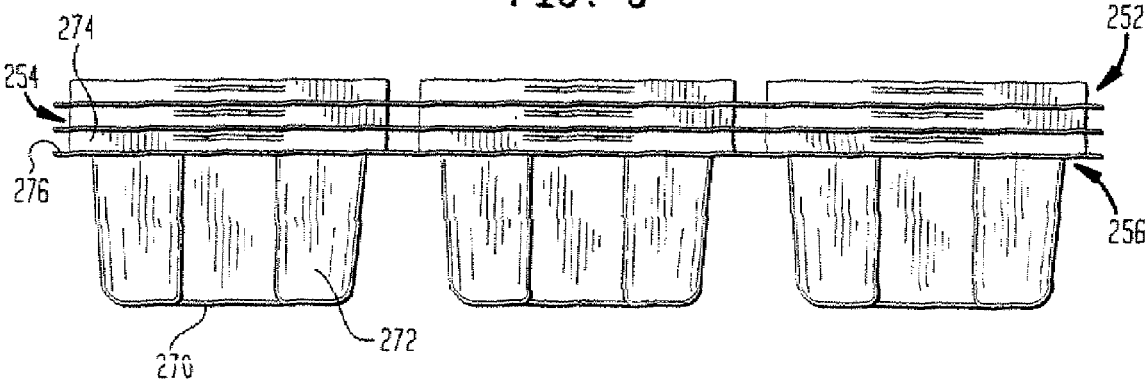
FIG. 9 is a view in elevation of a stack of nested cup array members.

Referring to FIGS. 8 and 9, there is shown a nested stack 250 of cup members including cup members 252, 254 and 256. Each cup member includes a plurality of cups such as cups 260, 262, 264, 266, 268 and 269. The members are integrally thermoformed from a sheet, for example. The cups have bottoms such as bottom 270, sidewalls such as sidewall 272 and brims such as brim 274. The cups further include skirts such as skirt 276 and include scores as illustrated at 278, 280. The bottom of each cup fits with the corresponding top recess of a lid member such as recesses 230-240 to make an assembled stack of sealed containers securely stackable as noted above. The components of the packaging system are compactly stored and a lid component may be used with a variety of cup components of different volume to provide flexibility and a minimum number of required components, while still providing color options so that servings can be color coded, if so desired.

While the invention has been described in connection with specific examples, modifications to those examples within the spirit and scope of the invention will be readily apparent to those of skill in the art. In view of the foregoing discussion, relevant knowledge in the art and references discussed above in connection with the Background and Detailed Description, the disclosures of which are all incorporated herein by reference, further description is deemed unnecessary.

What is claimed is:

1. A container ensemble, comprising:

an array comprising a plurality of substantially planar lids, each lid having a sealing channel and a skirt extending outwardly therefrom and completely thereabout, wherein the lids are integrally formed and tearably joined to each other, and an array comprising a plurality of cups, each cup having a brim and a skirt extending outwardly therefrom, wherein the cups are integrally formed and tearably joined to each other;

wherein the sealing channel and the brim are adapted to cooperate to form an assembled container having a substantially liquid proof seal, and wherein both the cup and lid arrays consist essentially of thermoformed polymeric material and are fabricated from different sheets of polymeric material.

2. The container ensemble of claim 1, wherein each lid and each cup comprises a plurality of rounded corners disposed about a periphery thereof.

3. The container ensemble of claim 2, further comprising a sealing bead centrally disposed on a wall of the sealing channel or a wall of the brim between each set of adjoining corners, wherein the sealing bead projects away from the wall of the channel or the wall of the brim and has a maximum distance of projection at a center thereof that tapers toward the wall as the sealing bead approaches each corner.

4. The container ensemble of claim 3, wherein a surface of an outer wall of the sealing channel is flat, wherein the sealing bead is disposed on an outer wall of the brim, and wherein the sealing bead is adapted to sealingly engage the flat surface of the sealing channel.

5. The container ensemble of claim 3, wherein a surface of an outer wall of the brim is flat, wherein the sealing bead is disposed on an outer wall of the sealing channel, and wherein the sealing bead is adapted to sealingly engage the flat surface of the brim.

6. The container ensemble of claim 3, wherein each sealing bead has an arched profile.

7. The container of claim 3, wherein each sealing bead has a semi-circular profile.

8. The container ensemble of claim 1, wherein the brim and the sealing channel have a U-shaped profile and are adapted to matingly engage one another.

9. A container assembly, comprising:

a first array comprising a plurality of substantially planar lids, each lid having a sealing channel and a skirt extending outwardly therefrom and completely thereabout, wherein at least four corners are disposed about the lid, and wherein the lids are integrally formed and tearably joined to each other; and a second array comprising a plurality of cups, each cup having a brim and a skirt extending outwardly therefrom, wherein at least four corners are disposed about the cup, and wherein the cups are integrally formed and tearably joined to each other, wherein the sealing channel and the brim are adapted to cooperate to form an assembled container having a substantially liquid proof seal, and wherein the brim comprises an inner wall and an outer wall; and a sealing bead centrally disposed on the outer wall of the brim between each set of adjoining corners, wherein the sealing bead projects away from the outer wall and has a maximum distance of projection at a center thereof that tapers toward the wall as the sealing bead approaches each corner.

10. The container assembly of claim 9, further comprising a sealing bead centrally disposed on the inner wall of the brim between each set of adjoining corners, wherein the sealing bead projects away from the inner wall into a volume of the cup and has a maximum distance of projection at a center thereof that tapers toward the inner wall as the sealing bead approaches each corner.

11. The container assembly of claim 9, wherein the sealing channel comprises an inner wall and an outer wall, wherein a sealing bead is centrally disposed on the outer wall of the sealing channel between each set of adjoining corners, wherein the sealing bead projects away from the outer wall and has a maximum distance of projection at a center thereof that tapers toward the outer wall of the sealing channel as the sealing bead approaches each corner.

12. The container assembly of claim 9, wherein the sealing channel comprises an inner wall and an outer wall, wherein a sealing bead is centrally disposed on the inner wall of the sealing channel between each set of adjoining corners, wherein the sealing bead projects away from the inner wall and has a maximum distance of projection at a center thereof that tapers toward the inner wall of the sealing channel as the sealing bead approaches each corner.

13. The container assembly of claim 9, wherein both the cup and lid arrays consist essentially of thermoformed polymeric material and are fabricated from different sheets of polymeric material.

14. A container assembly, comprising an array of cups and an array of lids;

wherein each lid comprises:

at least three rounded lid corners;

a lateral lid wall extending between two adjacent rounded lid corners; and a sealing channel and a skirt extending outwardly therefrom and completely thereabout, wherein the lids are integrally formed and tearably joined to each other;

wherein each cup comprises:

at least three rounded brim corners;

a lateral brim wall extending between adjacent rounded brim corners; and wherein the cups are integrally formed and tearably joined to each other, wherein the lateral lid walls are configured to engage the brim walls of a corresponding cup; and a sealing bead centrally disposed on each lateral lid wall or each lateral brim wall, wherein each sealing bead projects away from the lateral wall having a maximum distance at a central portion thereof and tapers downwardly to the lateral wall as the sealing bead approaches each adjacent corner.

15. The container assembly of claim 14, wherein the sealing bead continuously tapers downwardly from the maximum distance to the lateral wall as the sealing bead approaches each adjacent corner.

16. The container assembly of claim 14, wherein each lateral lid wall and each lateral brim wall have a sealing bead disposed thereon.

17. The container assembly of claim 14, wherein each lateral lid wall comprises a channel having an inner wall and an outer wall, and wherein the inner wall, the outer wall or both have a sealing bead disposed thereon.

18. The container assembly of claim 14, wherein each lateral brim wall comprises an inner wall and an outer wall, and wherein the inner wall, the outer wall, or both have a sealing bead disposed thereon.

19. The container assembly of claim 14, wherein each sealing bead has an arched profile.

20. The container assembly of claim 14, wherein each lateral lid wall includes a flat surface, wherein the sealing bead is disposed on the lateral brim wall, and wherein the sealing bead is adapted to sealingly engage the flat surface of the lateral lid wall.

* * * * *